US005283406A

United States Patent [19]

Olsen

[11] Patent Number: 5,283,406

[45] Date of Patent: Feb. 1, 1994

[54] SWITCH WITH MOVEABLE CARRIER AND MOVEABLE CONTACTS ATTACHED THERETO

[75] Inventor: David E. Olsen, Freeport, Ill.

[73] Assignee: Honeywell Inc, Minneapolis, Minn.

[21] Appl. No.: 953,602

[22] Filed: Nov. 23, 1992

[51] Int. Cl.[5] ..... H01H 1/20

[52] U.S. Cl. ..... 200/243; 200/245; 200/275; 403/233; 403/329

[58] Field of Search ..... 200/520, 530, 534, 540, 200/549, 562, 239, 243, 248, 257, 245, 271, 272, 275, 280, 281, 447, 449; 335/196, 197; 337/109, 137; 29/622; 403/329, 326, 400, 231, 233

[56] References Cited

U.S. PATENT DOCUMENTS

| | | | |
|---|---|---|---|
| 2,532,305 | 12/1950 | Heller | 200/281 |
| 2,546,663 | 3/1951 | Ballou et al. | 200/281 |
| 3,448,226 | 6/1969 | Mading et al. | 200/16 A |
| 3,646,491 | 2/1972 | Puetz | 335/197 |
| 3,922,627 | 11/1975 | Shepherd | 337/68 |
| 3,953,697 | 4/1976 | Teichert | 200/243 |
| 3,991,290 | 11/1976 | Bayles et al. | 200/250 |
| 4,045,635 | 8/1977 | Pursnani et al. | 200/283 |
| 4,114,007 | 9/1978 | Desiderio | 200/281 X |
| 4,154,996 | 5/1979 | Arnold | 200/243 X |

FOREIGN PATENT DOCUMENTS 1148627 12/1959 Fed. Rep. of Germany ..... 200/243

*Primary Examiner*—Henry J. Recla
*Assistant Examiner*—Glenn T. Barrett
*Attorney, Agent, or Firm*—William D. Lanyi

[57] ABSTRACT

A switch is provided with a moveable contact and contact carrier that significantly facilitates the manufacturing process necessary to make the assembly. The contact carrier is provided with first and second extensions that are generally flexible and associated with each other to provide a gap therebetween. In the preferred embodiment of the present invention, the second extension comprises first and second fingers that extend from the contact carrier. The second extension is provided with protuberances that permit a moveable contact to deform the second extension as it is moved inward toward the contact carrier. The extensions snap together after the complete moveable contact has moved into a predetermined space between the extensions. The assembly of the present invention permits the moveable contact to be permanently retained between the first and second extensions, but variable moveable in position within that containment to permit the position of the moveable contact to adjust to the position of fixed contact when the contact carrier is moved within a housing structure to force the moveable contacts into electrical communication with a pair of fixed contacts.

15 Claims, 9 Drawing Sheets

Fig.1A
(PRIOR ART)
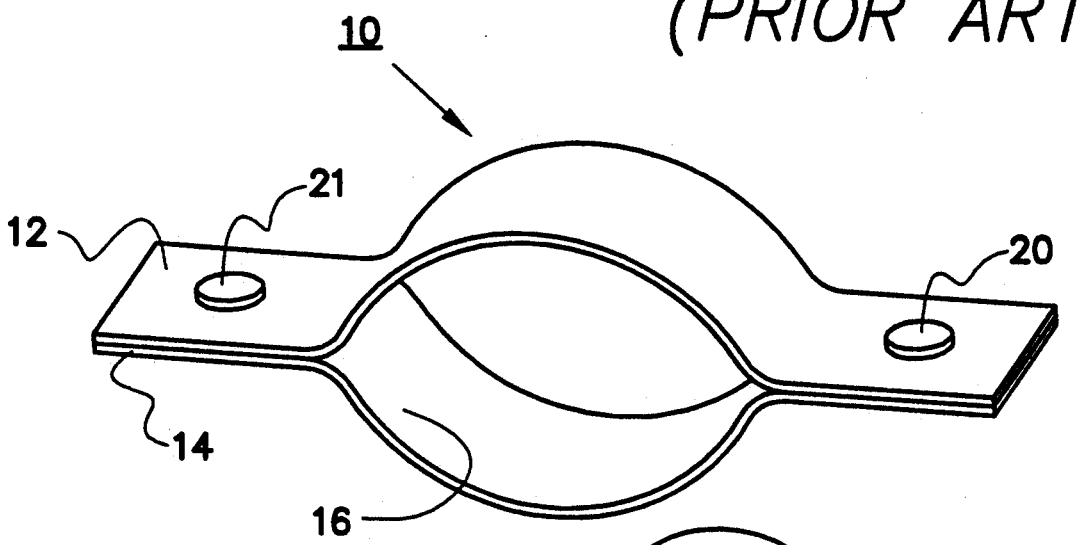
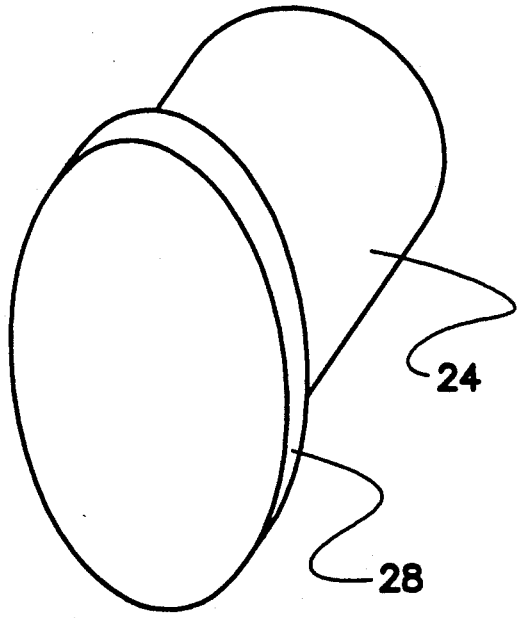
Fig.1B
(PRIOR ART)

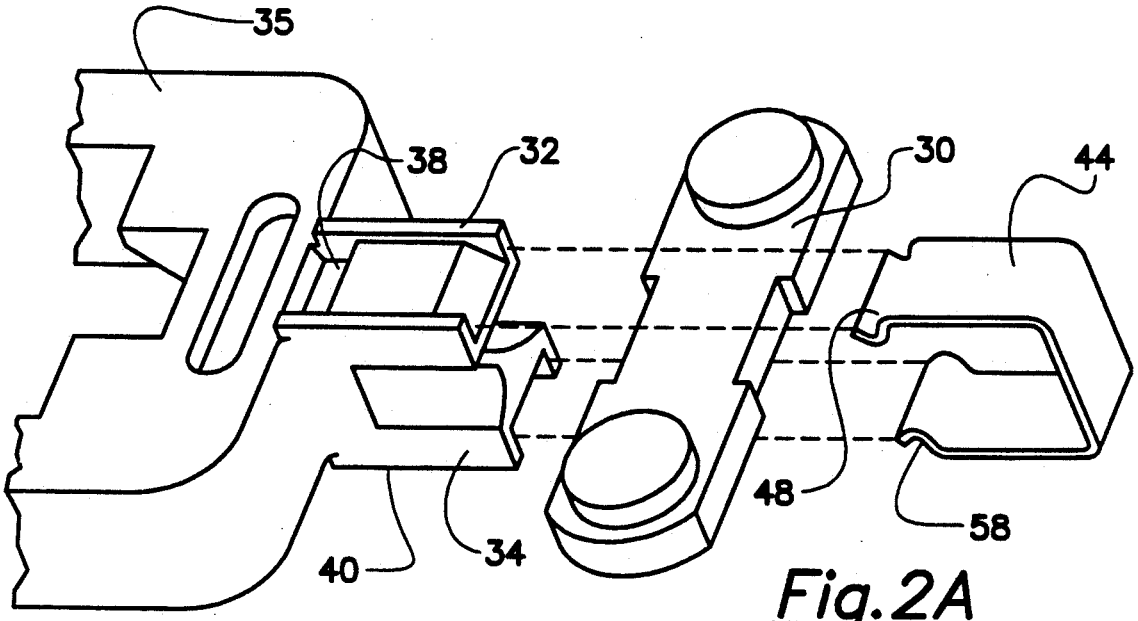
Fig. 2A
(PRIOR ART)
Fig. 2B
(PRIOR ART)
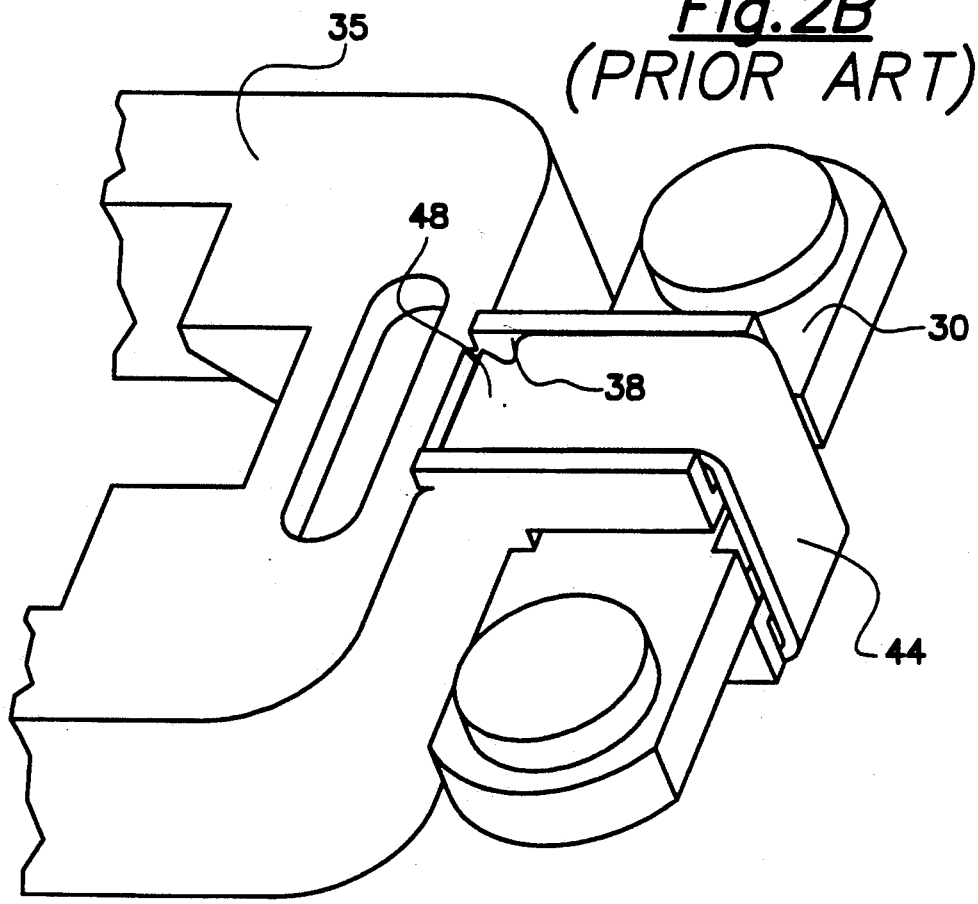

SWITCH WITH MOVEABLE CARRIER AND MOVEABLE CONTACTS ATTACHED THERETO

BACKGROUND OF THE INVENTION

1. Field of the Invention

The present invention is generally related to switches in which a moveable contact is attached to a contact carrier and, more particularly, to a switch in which the moveable carrier is provided with fingers between which the moveable contact is disposed.

2. Description of the Prior Art

As is well known to those skilled in the art, moveable contacts are usually attached to a contact carrier in a manner which permits the contacts to move, or wobble, relative to the contact carrier. The purpose of the variable motion is to assure proper contact between the moveable contact and stationary contacts across which the moveable contact provides an electrical bridge when actuated. If the moveable contact is rigidly attached to the contact carrier, the moveable contact could move into electrical connection with one of the stationary contacts and not the other. This type of misalignment could result in electrical arcing if only a slight contact force is provided against one of the stationary contacts or, alternatively, the electrical connection between the stationary contacts might not be made at all if the misalignment is severe.

The variable movement of the moveable contact relative to its contact carrier can be provided in several ways. One technique, which will be described in greater detail below, provides a moveable contact member that has an annular portion shaped to fit over a post attached to the contact carrier. The post is provided with an end portion that is shaped to permit the moveable contacts to be assembled over the end of the shaft and then rotated into its operating position. Another switch design that provides a variable attachment of the moveable contacts with respect to the contact carrier uses a clip to attach the two components together in a manner that provides the relative movement of the moveable contacts both with respect to the carrier and with respect to the stationary contacts.

U.S. Pat. No. 3,646,491, which issued to Puetz on Feb. 29, 1972, discloses a moveable contact structure for a large size electric switch that is arranged so that the contacts of the switch may be readily inspected. The contact structure includes a moveable contact retainer that has apertured ears and the base of the switch which supports the stationary contacts includes support posts, which, when the switch is disassembled to inspect the contacts, are available to act as a fulcrum for the shank of a screwdriver when the tip of the screwdriver is inserted into the apertures.

U.S. Pat. No. 3,448,226, which issued to Mading et al on Jun. 3, 1969, discloses a compact electrical contact block with electrically isolating bridging contacts. The block is of the type used in manually operable pushbutton assemblies. It includes an insulating housing and a reciprocating actuable plunger which supports two electrically isolated bridging contacts. Spring means and a sliding contact support provide for wear allowance and contact pressure.

U.S. Pat. No. 4,045,635, which issued to Pursnani et al on Aug. 30, 1977, describes as electrical switch construction that has a housing provided with an actuator for causing movement of a moveable switch blade relative to a over travel compensating fixed switch blade.

The fixed switch blade is secured to a rigid terminal carried by the housing. It is provided with an extension thereof that is disposed in the path of movement of the fixed switch blade in order to limit movement thereof in one direction.

U.S. Pat. No. 3,991,290, which issued to Bayles et al on Nov. 9, 1976, discloses an anti-rock preventing means for use with electric switch contacts. The device is intended for use with electrical switches of the sort that are capable of carrying high amperage currents, especially under short circuit conditions. It is provided with a ferromagnetic U-shaped yoke piece around the contacts and an armature mounted on the moveable contact carrier in position to be attracted by the magnetic force created in the yoke when current flows through the contacts.

U.S. Pat. No. 3,953,697, which issued to Teichert on Apr. 27, 1976, discloses a dual fulcrum switch in which the switch includes a housing which carries a first contact defining a first fulcrum and has an elongated electrically conductive lever blade disposed in overlying relationship. It carries a second contact from one end thereof for normally engaging the first contact. A third contact is carried from the opposite end of such blade and it is moveable through a predetermined path to engage a fourth contact carried from the housing and defining a second fulcrum.

U.S. Pat. No. 3,922,627, which issued to Shepher Nov. 25, 1975, describes a double-throw single-pull switch that comprises a resilient moveable contact arm fixed at one end and carrying a first contact on one surface of the free end thereof for engagement with a mating stationary second contact. The contact arm carries on its opposite surface a third contact positioned intermediate the fixed and free ends thereof for engagement with a mating stationary fourth contact. Means are provided for selectively applying force to the contact arm intermediate its free and fixed ends for moving the contact arm to make and break the first and second contacts and to make and break the third and fourth contacts.

The attachment of moveable contacts to a contact carrier assembly in such a way that the moveable contacts are variable in position to provide the necessary wobble for achieving the purposes described above normally necessitates a contact carrier having a shape which necessitates complex and expensive molding techniques in order to manufacture the contact carrier. In addition, known designs of contact carriers and moveable contacts attached thereto require numerous parts and expensive assembly processes. It would therefore be beneficial if a switch could be made which simplifies the design of contact carrier and facilitates assembly of the moveable contacts to the contact carrier while maintaining all of the desirable attributes of a contact carrier with moveable contacts described above.

SUMMARY OF THE INVENTION

The present invention is a switch which comprises a housing with at least one pair of stationary contacts rigidly attached thereto. The housing is shaped to receive a contact carrier in sliding association therein. The contact carrier, in turn, is shaped to receive and hold at least one moveable contact member in such a way that the moveable contact member is retained but not rigidly attached to the contact carrier and is able to wobble in response to forces exerted by external objects, such as the pair of stationary contacts, when the moveable contact member is moved into contact therewith.

The contact carrier is provided with first and second extensions between which the moveable contact is disposed. In a preferred embodiment of the present invention, the first extension comprises a single finger extending from the contact carrier and the second extension comprises two flexible fingers which extend from the contact carrier. The two fingers of the second extension are disposed in a common plane. A preselected one of the first and second extensions is provided with a protuberance which extends toward the other extension. The protuberance is shaped to provide a means for preventing the moveable contact from moving in a direction away from the contact carrier after the moveable contact is assembled between the first and second extensions. The moveable contact is provided with a notch that is shaped to receive the protuberance therein to further prevent the moveable contact from moving relative to the first and second extensions in a direction perpendicular to the one described above which is away from the contact carrier.

After being assembled between the first and second extensions, the contact carrier is loosely held in place with sufficient gaps between the moveable contact and the first and second extensions to allow the moveable contact to wobble without moving out of containment between the extensions.

BRIEF DESCRIPTION OF THE DRAWINGS

The present invention will be more fully understood from a reading of the Description of the Preferred Embodiment in conjunction with the drawings, in which:

FIGS. 1A and 1B show components of a known moveable contact arrangement;

FIGS. 2A and 2B show another known assembly technique for a moveable contact and a contact carrier;

DESCRIPTION OF THE PREFERRED EMBODIMENT

Figure 3:
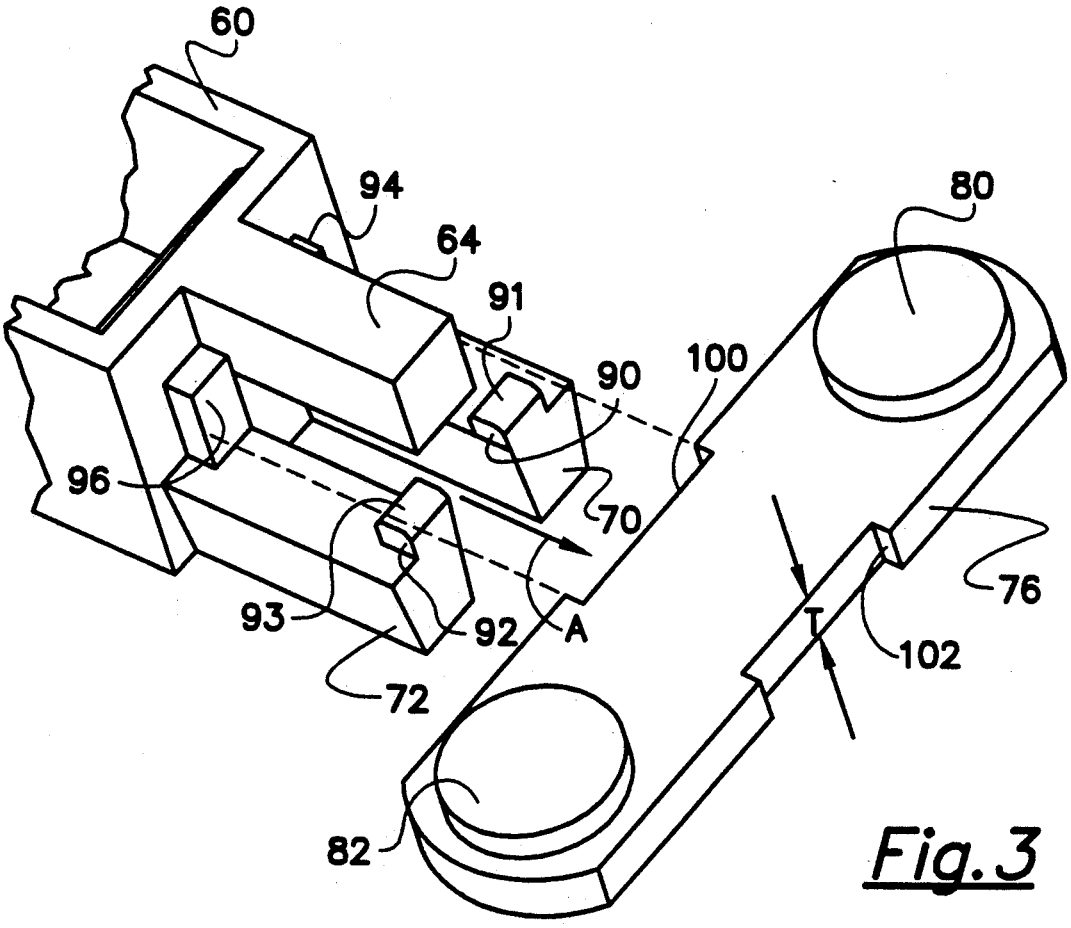
FIG. 3 shows an exploded partial view of the present invention.

As described above, those skilled in the art of switch design have recognized for many years that a moveable contact attached to a contact carrier should be arranged so that it can move, or wobble, relative to the contact carrier. The primary advantage of this relative movement is that a misalignment between stationary contacts and moveable contacts can be accommodated if the position of the moveable contact is variable with respect to the contact carrier.

With reference to FIG. 1A, a known style of moveable contact is shown. As can be seen, this type of moveable contact 10 comprises an upper portion 12 and a lower portion 14. These upper and lower portions are distorted so that, when attached together, they define a generally ovate central opening 16 therebetween. The assembled moveable contact 10 also comprises two contact pads, 20 and 21, that are attached to its upper surface. In one embodiment of this known type of moveable contact 10, the contact pads, 20 and 21, extend completely through both portions and serve as a means for attaching the portions together while also providing pads on the underside of the moveable contact 10.

FIG. 1B illustrates a post portion of a contact carrier that is typically used in association with the moveable contact 10 shown in FIG. 1A. The post, 24, is generally circular in cross section and has an end portion 28 that is generally ovate. With reference to both FIGS. 1A and 1B, it should be understood that the shape of the end portion 28 is generally equivalent to, but slightly smaller than, the opening 16 in the moveable contact of FIG. 1A. The moveable contact 10 and the post 24 cooperate together to permit the opening 16 to pass over the ovate end portion 28 when the two components are arranged with the major and minor axes of the oval shaped portions aligned properly. After the opening 16 passes over the ovate end portion 28, the moveable contact 10 is rotated 90 degrees and assembled into a switch housing. When misaligned in this way, the ovate end portion 28 prevents the moveable contact 10 from passing in a direction away from a contact carrier and over the lip portion of the ovate end portion 28.

FIGS. 2A and 2B show another known means of attaching a moveable contact to a contact carrier in such a way that the moveable contact occupies a position with is variable with respect to the contact carrier. As shown in FIG. 2A, two flanges are arranged to provide a gap therebetween which is shaped to receive a moveable contact 30 therebetween. The flanges, 32 and 34, extend from a contact carrier 35 as shown in FIG. 2A. The flanges are provided with grooves, 38 and 40 (not visible in FIGS. 2A and 2B), that are shaped to receive a portion of a clip 44 therein. The clip 44 is bent in a generally U-shaped configuration and provided with ends which are deformed to form ridges, 48 and 58, which are shaped to be received in the grooves, 38 and 40. After the moveable contact 30 is inserted between the flanges, the clip 44 is passed over the outwardly directed surfaces of the flanges until the ridges, 48 and 58, snap into the grooves, 38 and 40, to retain the moveable contact 30 in position. FIG. 2B shows the assembled device.

Although the devices shown in FIGS. 1A, 1B, 2A and 2B satisfy the requirement of variability in the position between the moveable contact and the contact carrier, these designs create significant difficulty during the manufacture of the contact carrier and during the assembly of the parts when the switch is manufactured. For example, the contact carrier 10 shown in FIG. 1A requires two portions, 12 and 14, to first be manufactured and then accurately bent to form the proper shape prior to the attachment of the two portions together to form the moveable contact 10. In addition, the ovate end portion 28 of the post shown in FIG. 1B is a difficult plastic molding operation that must be performed during the manufacture of the contact carrier. Although the configuration shown in FIG. 1B can be made in a two slide mold, parting lines generated during the molding process on the pivot diameter is a disadvantage of the design. A four slide mold is required to produce the part shown in FIG. 2A. The four mold sections pull away from each other along lines which are 90 degrees apart to generate the molded part. The requirement for a multi slide mold such as this can account for approximately 50 to 60 percent higher costs than a conventional mold. In addition, the costs of the part is increased because of the longer necessary cycle times required for parts of this type.

The known configuration shown in FIGS. 2A and 2B requires that the moveable contact 30 be assembled between the flanges 32 and 34, and held in that position as the clip 44 is positioned and attached to the flanges. If the relative dimensions of the flanges and the clip are selected to facilitate the assembly, they create the risk of an assembly that is too loose and which might disassemble after the switch is manufactured. On the other hand, if the relative dimensions of the clip and the flanges are selected to assure that the clip will remain in position during operation, the relative dimensions may be sufficiently small to exacerbate the assembly process of placing the clip over the flanges while holding the moveable contact in position. In addition, the contact carrier 35 also requires a complex mold during its manufacture.

A preferred embodiment of the present invention is partially illustrated in FIG. 3 where a contact carrier 60 is shown with extensions attached thereto. A first extension 64 comprises an element having a rectangular cross section. A second extension comprises first and second fingers which are identified be reference numerals 70 and 72, respectively. The two fingers, 70 and 72, are disposed in a common plane. The first and second extensions are arranged relative to each other to provide a gap therebetween which is shaped to receive a moveable contact in clearance relation therein. For example, the moveable contact 76 is also illustrated in FIG. 3 and positioned relative to the first and second extensions to illustrate their relative positions prior to assembly of the moveable contact 76 into the gap between the first and second extensions. The shape of the moveable contact 76 is generally known to those skilled in the art and is also illustrated in FIGS. 2A and 2B and identified by reference numeral 30. It has a plate portion with a thickness T and two contact pads, 80 and 82 on its upper surface. It should be understood that similar pads are provided on the lower surface, but are not shown in FIG. 3.

With continued reference to FIG. 3, it can be seen that the second extension, which comprises fingers 70 and 72, is provided with a means for preventing the moveable contact from moving away from the contact carrier 60, in the direction of arrow A, after it is assembled between the first and second extensions. In a preferred embodiment of the present invention, the two protuberances, 90 and 92, are provided for this purpose. The tapered upper surfaces, 91 and 93, of the protuberances permit the central region of the moveable contact 76 to be forced between the upper surfaces, 91 and 93, of the protuberances, 90 and 92, and the lower surface of the first extension 64. As the thickness T is forced between these opposing surfaces, the first and second extensions are forced apart, as a result of the flexibility of fingers 70 and 72, to permit passage of the moveable contact 76 therebetween until it is forced completely into the region between the blocks, 94 and 96, of the contact carrier 60 and the inwardly facing surfaces of the protuberances, 90 and 92. This position of the moveable contact 76 with respect to the first and second extensions will be described in greater detail below. It should be understood that the moveable contact 76 is also provided with contact pads on the underside of the moveable contact shown in FIG. 3. However, those additional pads are not visible in the illustration of FIG. 3. In addition, it can be seen that the moveable contact 76 is provided with notches, 100 and 102, in its side surfaces.

Figure 4:
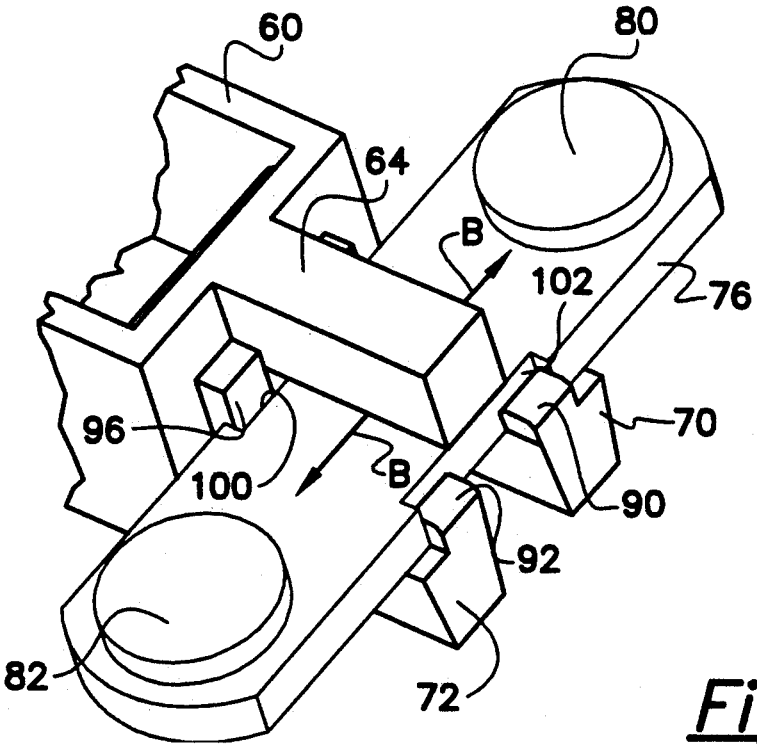
FIG. 4 shows an assembled version of the illustration in FIG. 3.

FIG. 4 shows the contact carrier 60 with the moveable contact 76 disposed between its first and second extensions. With reference to both FIGS. 3 and 4, it can be seen that a movement of the moveable contact 76 toward the contact carrier 60, as illustrated by dashed lines in FIG. 3, will cause the thickness T of the moveable contact to be forced between the upper sloped surfaces of the protuberances, 90 and 92, and the lower surface of the first extension 64. After the notches, 100 and 102, pass over the protuberances, the flexibility of the second extension causes it to snap back toward the first extension and capture the moveable contact therebetween. FIG. 4 illustrates the relationship between blocks 9 (not visible in FIG. 4) and 96 and protuberances 90 and 92 in association with the notches, 100 and 102, to limit movement in the directions of arrow B.

Figure 5:
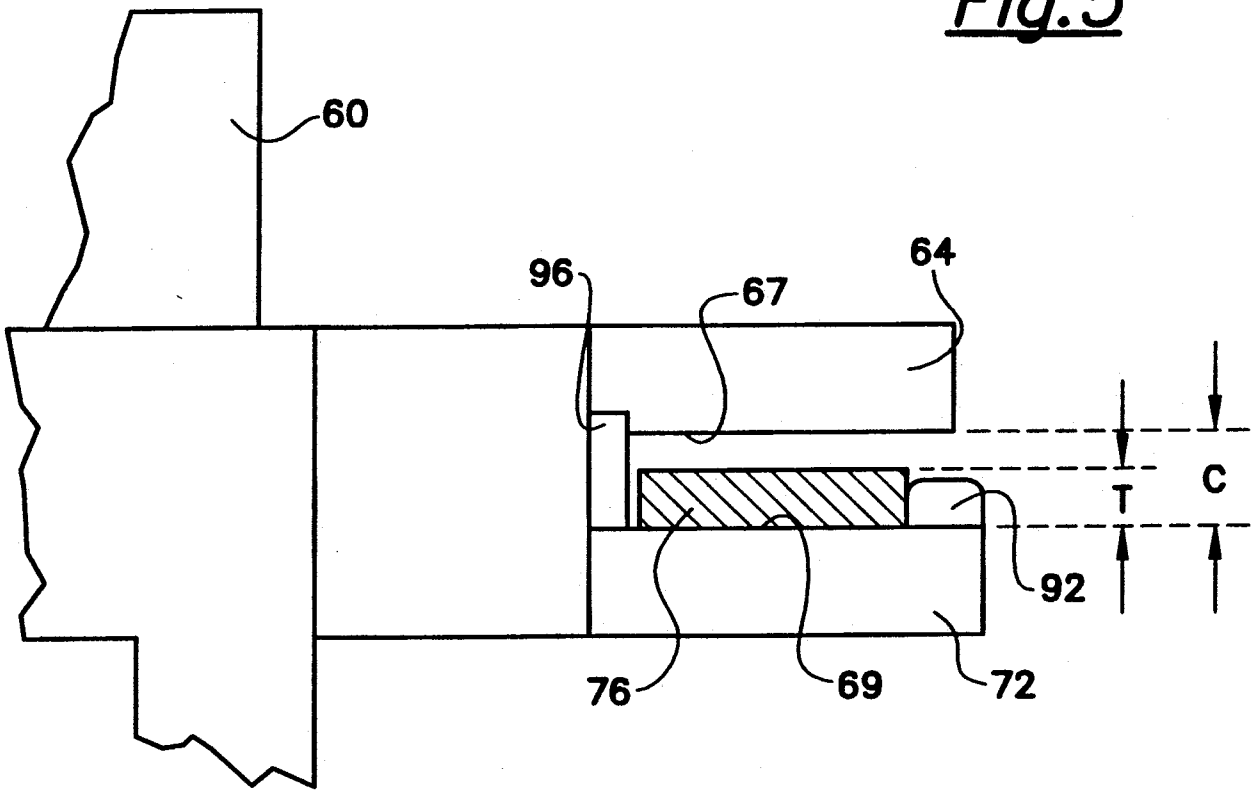
FIG. 5 shows a side view of the extensions provided by the present invention.

FIG. 5 is a side view of the contact carrier 60 and the first and second extensions. The first extension 64 is shown extending from the contact carrier 60 and the second finger 72 of the second extension is also shown extending from the contact carrier 60. The facing surfaces, 67 and 69, of the first and second extensions define a clearance C therebetween. The thickness of the moveable contact 76, which is shown in cross section in FIG. 5, is identified by reference letter T in FIG. 5. As can be seen, thickness T is less than the clearance C and therefore the moveable contact 76 is free to move in the space between the first and second extensions. Furthermore, although not identified by a particular reference numeral or letter in FIG. 5, it can also be seen that the width of the moveable contact is less than the distance between the block 96 and the protuberance 92 and, therefore, movement between those surfaces is also permitted. The combined movement permitted by the relative sizes of the moveable contact and the dimensions provided between the extensions and between the protuberances and blocks permit a variability of position between the moveable contact and its contact carrier.

Figure 6:
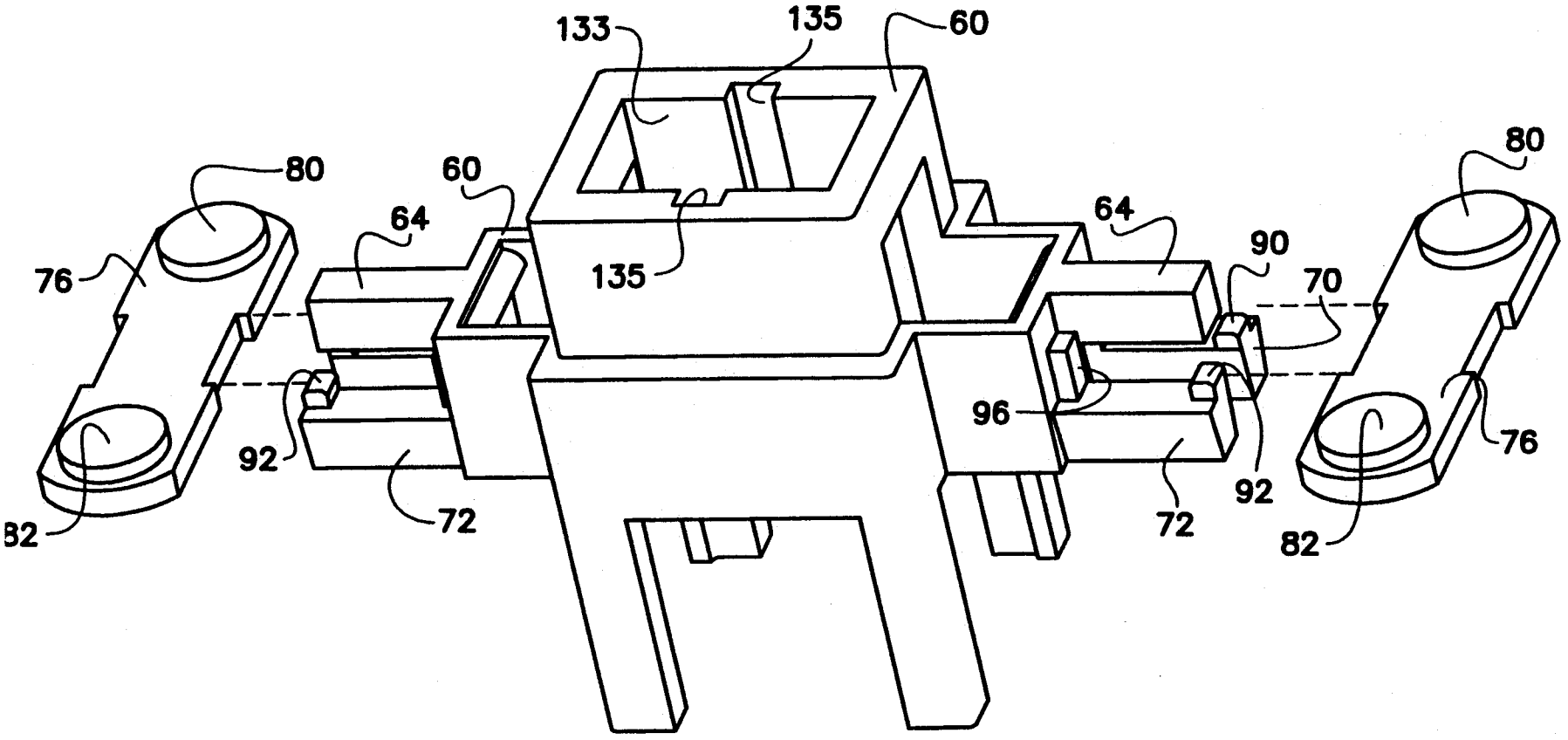
FIG. 6 shows a complete contact carrier in an exploded view with two moveable contact.

FIG. 6 illustrates a exploded view of a complete contact carrier 60 arranged to show its two sets of extensions that are, in turn, each configured to receive a moveable contact 76. In a preferred embodiment of the present invention, a contact carrier 60 such as that shown in FIG. 6 is used to provide a double pole, double throw switch. The illustration of FIG. 6 shows the contact carrier 60 and moveable contacts 76 prior to assembly, but it should be understood that both sides of the structure shown in FIG. 6 would be assembled in a manner such as that described above to result in an assembly such as that shown in FIG. 4.

Figure 7:
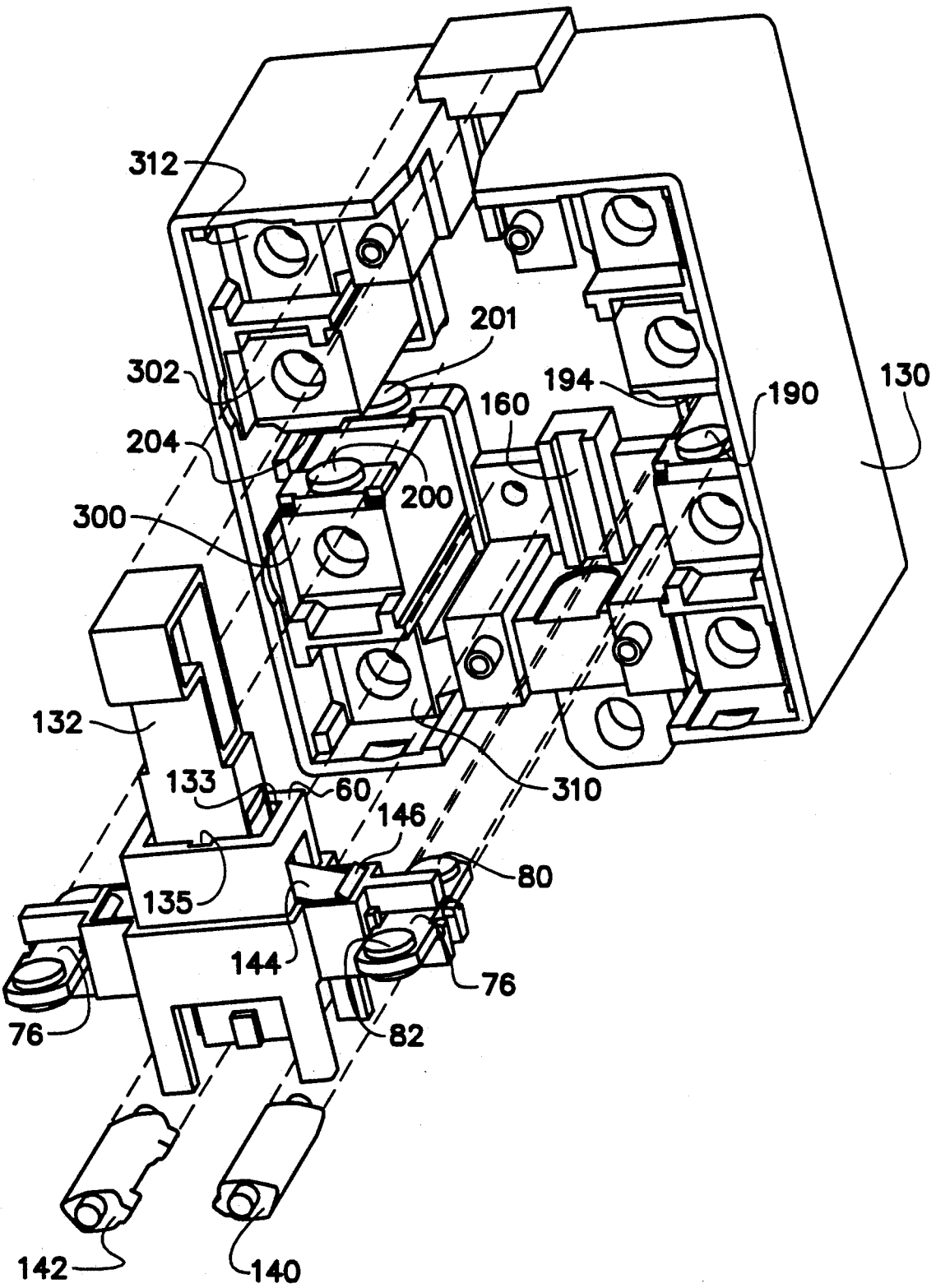
FIG. 7 illustrates an exploded view of a switch housing in association with a contact carrier and a moveable plunger.

In FIG. 7, an exploded view of a switch is shown with a housing 130 represented in relation to a contact carrier 60. In FIG. 7, the contact carrier 60 is shown in an exploded view, but with dashed lines representing the appropriate assembled position of the contact carrier 60 within the housing 130. A moveable plunger 132 is disposed within an opening 133 of the contact carrier 60. Positive break cams, 140 and 142, are shown below the legs of the contact carrier 60. After assembly of the moveable plunger 132 within the contact carrier 60, a spring 144 is arranged between a pivot 146 of the contact carrier 60 and an opposite pivot 154 contained within the moveable plunger 132.

Figure 8:
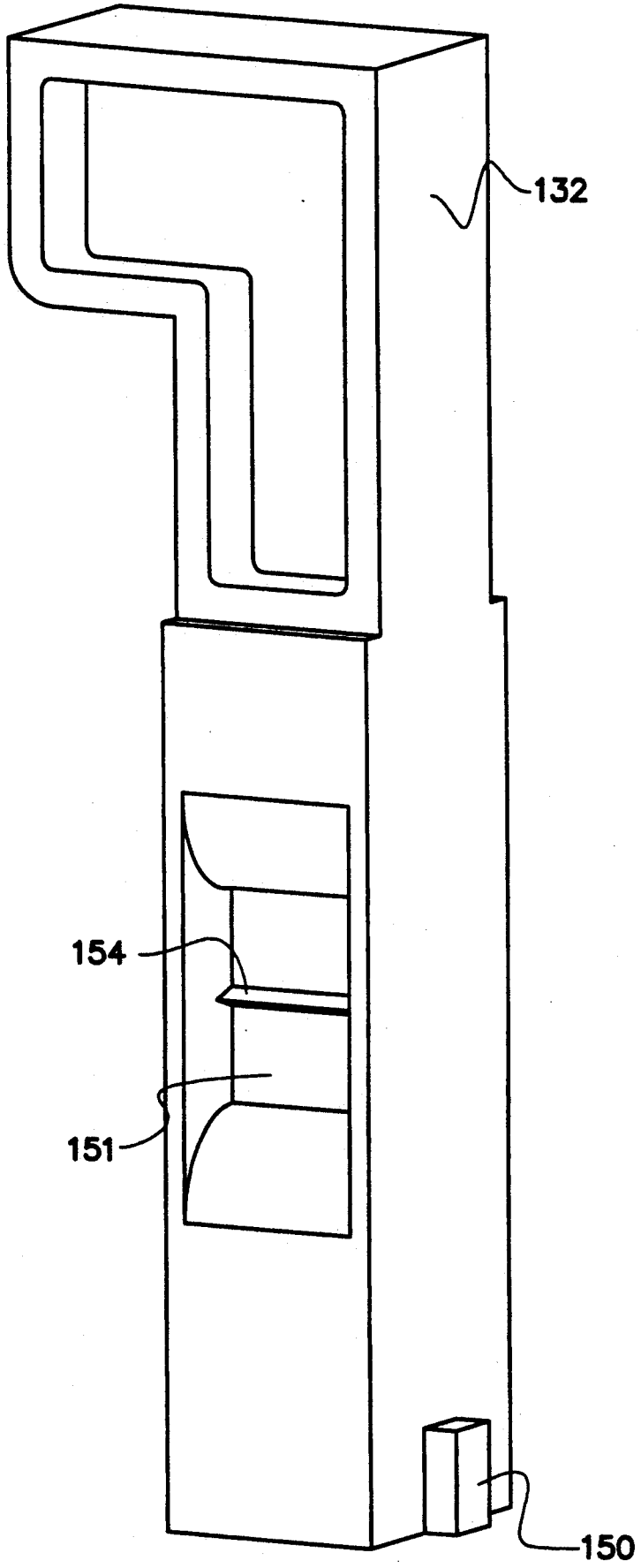
FIG. 8 shows the moveable plunger used in a switch made in accordance with the present invention.

FIG. 8 illustrates the moveable plunger 132 that has a tooth 150 extending therefrom. Grooves 135 permit the tooth 150 to pass through opening 133 in either of two relative configurations. Inside the central opening 151 of the moveable plunger 132, pivot 154 is provided for attachment of the spring 144. It should be understood that two springs are used in conjunction with the moveable plunger 132 and the contact carrier 60. The tooth 150 of the moveable plunger 132 is shaped to be received in the track 160 illustrated in FIG. 7. The track 160 cooperates with the tooth 150 to align the reciprocating movement of the moveable plunger 132 with respect to the housing 130.

Figure 9:
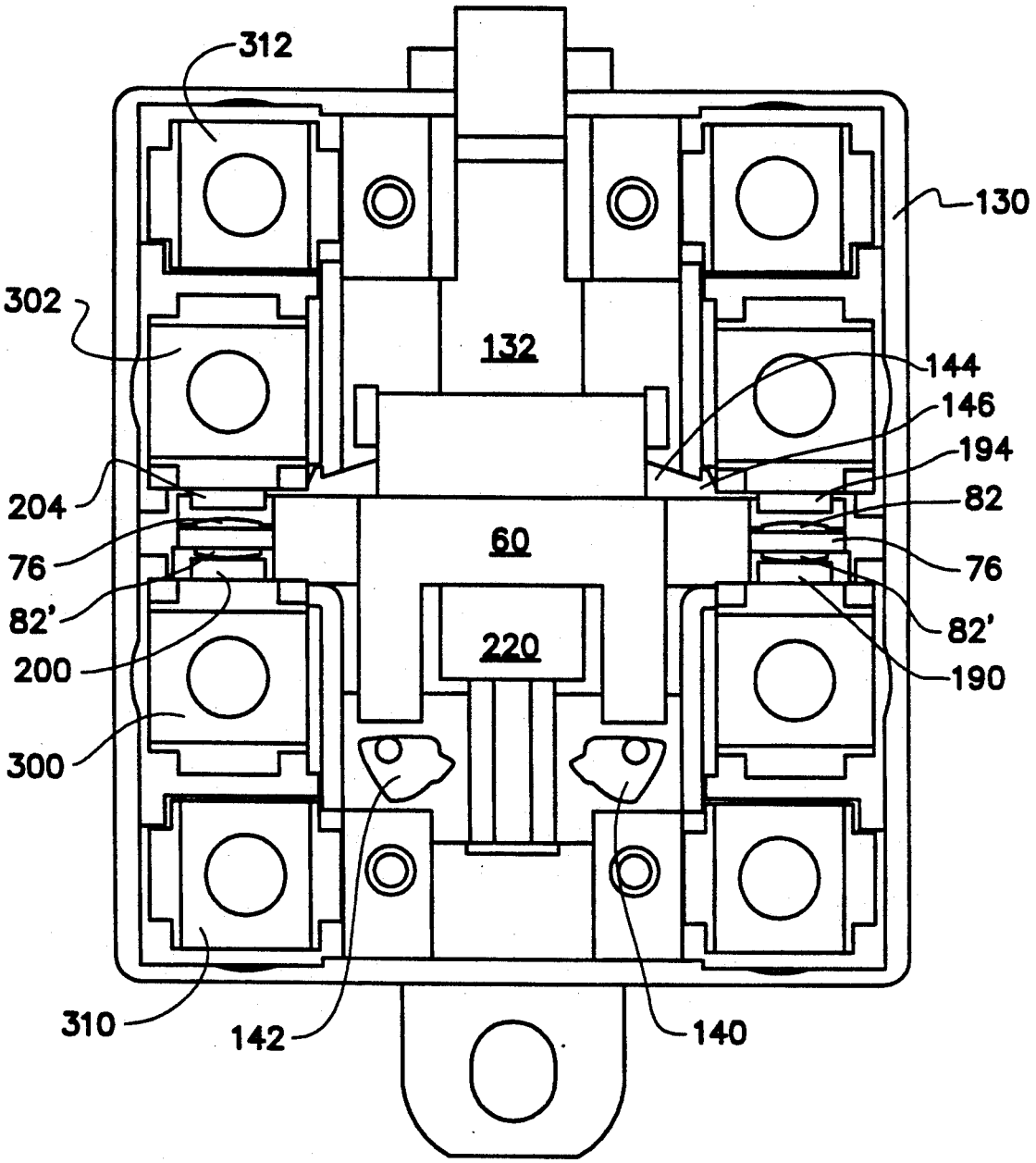
FIG. 9 shows a front view of an assembled switch incorporating a contact carrier and moveable contact made in accordance with the present invention.

FIG. 9 shows a front view of a switch housing 130 with the contact carrier 60 and moveable plunger 132 disposed therein. The illustration in FIG. 9 does not show a cover which would otherwise block the illustrated components from view. It can be seen that the moveable contact 76 is provided with contact pads on its upper and lower surfaces. Although only two contact pads, 80 and 82, have been shown in the previous illustrations, it should be understood that similar contact pads are disposed on the opposite of the moveable contact 76. The lower contact pad is identified by reference numeral 82'. The housing 130 provides pairs of stationary contacts which are rigidly attached to the housing 130 and positioned to permit them to be bridged electrically by the moveable contact 76. For example, reference numeral 190 identifies the position of one stationary contact that is disposed directly below contact pad 82' of the moveable contact 76. Although not clearly illustrated in FIG. 9, it should be understood that another stationary contact, similar to the one identified with reference numeral 190, is located behind it in FIG. 9 and positioned so that the downward movement of the moveable contact 76 causes its contact pads to contact each of the pair of stationary contact pads to bridge them electrically. This concept is well known to those skilled in the art. A similar pair of stationary contacts is represented by reference numeral 194 in FIG. 9. The two pairs of stationary contacts, 190 and 194, are disposed below and above the moveable contact 76 on the right side of the illustration. Since the switch is symmetrical, a similar pair of stationary contacts 200 is located below the moveable contact 7 attached to the left side of the contact carrier 60 in FIG. 9. Furthermore, another stationary pair of contacts 204 is disposed directly above the moveable contact 76.

Since the switch shown in FIG. 9 is a positive acting switch, downward movement of the moveable plunger 132 causes a bottom portion 220 of the plunger to contact the positive break cams, 140 and 142. Rotation of these cams about their central axes causes an upward force to be exerted against the bottom surfaces of the feet of the contact carrier 60 to force it upward and break the electrical contact between the moveable contacts 76 and the pair of stationary contacts located directly below them.

With respect to the left side of FIG. 9, it should be understood that downward movement of the moveable contact 76 bridges the necessary pair of stationary contacts to provide electrical communication between the component identified by reference 300 and that identified by reference 302. Similarly, upward movement of the moveable contact 76 toward the pair of stationary contacts identified with reference numeral 204, will provide electrical communication between the components identified with reference numerals 310 and 312 respectively. The right side of the switch shown in FIG. 9 operates in the same manner because of the symmetry of the design. Reference numeral 320 identifies four posts that are used to align an additional cover (not shown in the Figures) which is normally disposed over the internal components shown in FIG. 9. With reference to FIGS. 7 and 9, the relationship between the pairs of stationary contacts can be seen. Also, the relationship between the two moveable contacts 76 and the four pairs of stationary contacts can be more clearly understood.

Figure 10:
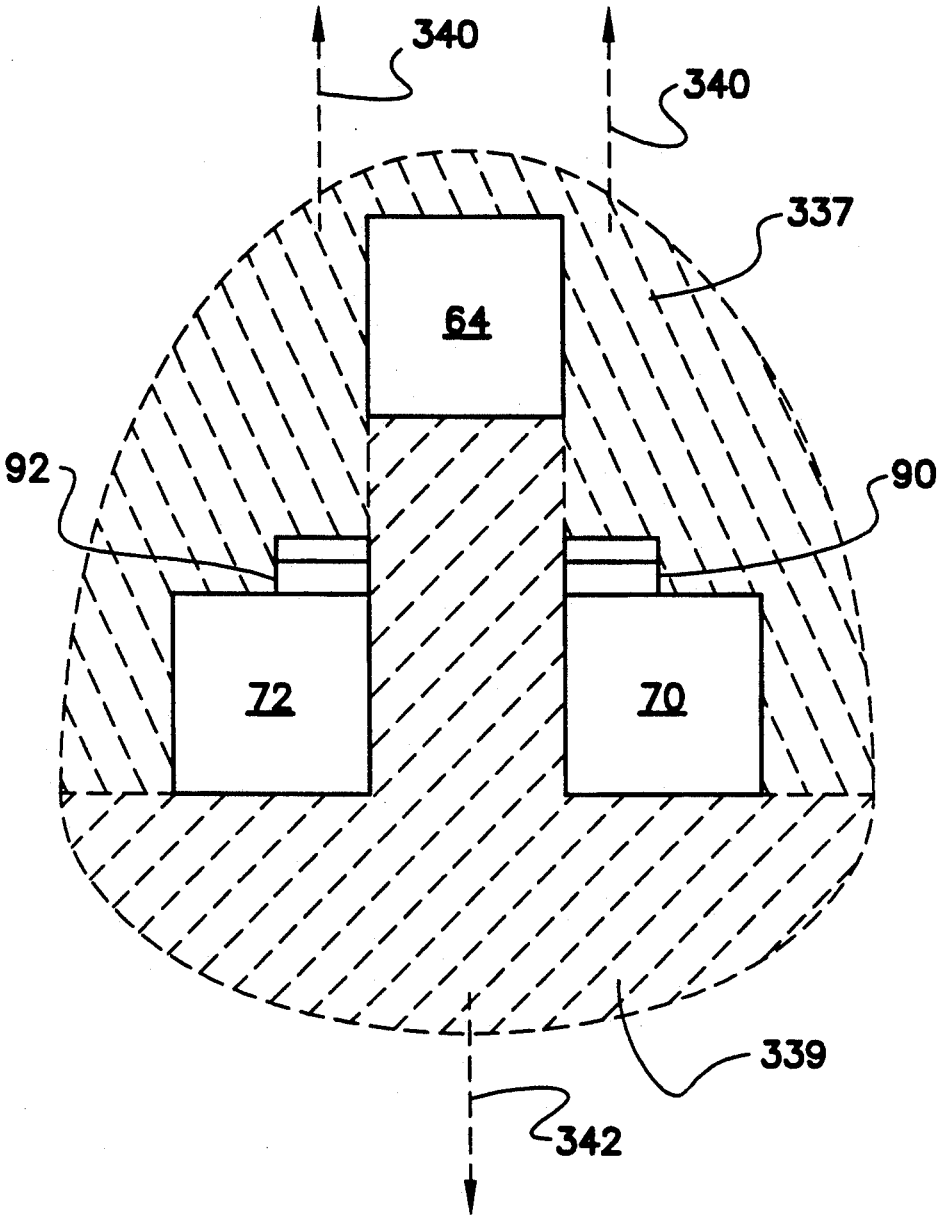
FIG. 10 illustrates a manufacturing advantage of the present invention.

In the Description of the Preferred Embodiment, it was mentioned that the contact carriers known in the prior art, and illustrated in FIGS. 1A, 1B, 2A and 2B, are difficult to manufacture. The difficulty is partially due to the complex molding procedures that must be utilized to produce the part. As is well known to those skilled in the art, the shape of the molded piece determines the number of mold segments necessary to produce it. In relatively simple molded parts, a two section mold can be used. For more complex parts, a four section mold is necessary. One of the advantages of the present invention results from its use of a second extension that comprises two fingers, 70 and 72. FIG. 10 illustrates one advantage of this design. It should be understood that the illustration of FIG. 10 is exemplary and has been simplified for purposes of this discussion. FIG. 10 shows an end view of the first extension 64 and the two fingers, 70 and 72, of the second extension. During the molding process, a first mold section 337 and a second mold section 339 are arranged together as represented by the dashed outlines and the dashed cross sectioned lines. After the molding process is complete, mold section 337 can be moved in the direction indicated by arrows 340 and mold section 339 can be moved in the direction indicated by arrow 342, thus permitting the contact carrier to be manufactured with the use of a two-sectioned mold. If the second extension was made of a solid piece, rather than the two fingers, a more complex molding procedure would be necessitated in order to form the surfaces below the first extension 64 in FIG. 10 and above the second extension. In other words, the space directly between the first and second extensions would require at least a third mold section if the second extension did not comprise the two fingers, 70 and 72, which permit the mold section 339 to pass therebetween and perform the necessary function of shaping the associated surfaces.

It should be understood that design of the present invention not only permits a simplified molding process to be used to manufacture the contact carrier, but also simplifies the assembly procedure by which the moveable contact is disposed between the first and second extensions and attached to the contact carrier in such a way that a predetermined amount of wobble is provided to permit the moveable contact to be variable in position relative to the contact carrier.

Although the present invention has been described with considerable specificity and illustrated with significant detail, it should be understood that many other embodiments of the present invention are possible within its scope.

The embodiments of the invention in which a exclusive property or right is claimed are defined as follows:

1. A switch, comprising:
a housing;
a contact carrier disposed within said housing, said housing being shaped to receive said contact carrier in reciprocating association therein;
a first pair of stationary electrical contacts rigidly supported within said housing; and
a moveable contact, said moveable contact being pressed between a first extension of said carrier and a second extension of said contact carrier, the position of said moveable contact being variable in relation to said contact carrier in response to flexing of said first and second extensions of said contact carrier, said moveable contact being moveable into bridging contact between said first pair of stationary electrical contacts in response to movement of said contact carrier in a first direction within said housing, said first extension comprising a flexible finger extending from said contact carrier, said second extension comprising two flexible fingers disposed in a common plane, said two flexible fingers extending from said contact carrier.

2. The switch of claim 1, further comprising:
a second pair of stationary electrical contacts rigidly supported within said housing, said moveable contact being movable into bridging contact between said second pair of stationary electrical contacts in response to movement of said contact carrier in a second direction within said housing.

3. The switch of claim 1, wherein:
a preselected one of said first and second extensions comprises a protuberance for retaining said moveable contact in position between said first and second extensions and for preventing said moveable contact from moving in a direction away from said contact carrier.

4. The switch of claim 3, wherein:
said moveable contact comprises a notch shaped to receive said protuberance therein.

5. A switch, comprising:
a contact carrier;
a housing shaped to receive said contact carrier in reciprocating association therein, said contact carrier being disposed within said housing;
a first pair of stationary contacts rigidly attached to said housing;
a moveable contact; and
means for retaining said moveable contact in a position relative to said contact carrier wherein said moveable contact is held by said retaining means in a variable association relative to said contact carrier in response to flexing of said retaining means, said retaining means comprising a first extension and a second extension attached to said contact carrier, said first extension comprising a flexible finger, said second extension comprising a pair of flexible fingers.

6. The switch of claim 5, wherein:
said moveable contact is disposed between said flexible finger and said pair of flexible fingers.

7. The switch of claim 5, wherein:
a preselected one of said first and second extensions comprises a protuberance for preventing said moveable contact from moving in a first direction away from said contact carrier.

8. The switch of claim 7, wherein:
said moveable contact comprises a notch for preventing said moveable contact from moving in a second direction.

9. The switch of claim 8, wherein:
said notch is shaped to receive said protuberance therein.

10. The switch of claim 9, further comprising:
a second pair of stationary contacts rigidly attached to said housing, said moveable contact being disposed between said first and second pairs of stationary contacts.

11. The switch of claim 10, wherein:
said moveable contact is moveable into bridging contact between said second pair of stationary contacts in response to movement of said contact carrier.

12. A switch, comprising:
a housing;
a contact carrier, said housing being shaped to receive said contact carrier in reciprocating association therein;
a first pair of stationary electrical contacts rigidly supported within said housing; and
a moveable contact, said contact carrier having a first extension and a second extension attached thereto, said first extension and said second extension being spaced apart to receive said moveable contact therebetween, said second extension comprising means for preventing said moveable contact from moving out of a space between said first extension and said second extension, said preventing means comprising a protuberance extending from said second extension toward said first extension, said protuberance being spaced apart from said first extension by a distance that is less than the thickness of said movable contact, said first extension and said second extension being sufficiently flexible to permit said moveable contact to pass in interfering relation therebetween, the position of said moveable contact being variable in relation to said contact carrier in response to flexing of said first extension and said second extension of said contact carrier, said moveable contact being moveable into bridging contact between said first pair of stationary electrical contacts in response to movement of said contact carrier in a first direction within said housing.

13. The switch of claim 12 further comprising:
a first pair of fixed contacts rigidly attached to said housing, said contact carrier being moveable to cause said movable contact to connect said pair of stationary contacts electrically to each other.

14. The switch of claim 13, wherein:
said second extension comprises two fingers.

15. The switch of claim 13, further comprising:
a second pair of stationary contacts rigidly attached to said housing, said movable contact being disposed between said first and second pairs of stationary contacts and being alternately moveable into contact across said first and second pairs of stationary contacts in response to reciprocating movement of said contact carrier.

* * * * *